US005547184A

United States Patent [19]

Coombs et al.

[11] Patent Number: 5,547,184

[45] Date of Patent: Aug. 20, 1996

[54] RESILIENT SHEET TRANSPORT SYSTEM

[75] Inventors: Peter M. Coombs, Tustin, Calif.; Klaus Thogersen, Klampenborg, Denmark; Edward Seibel, Fountain Valley, Calif.

[73] Assignee: Bradco (Japan) Ltd., Tokyo, Japan

[21] Appl. No.: 332,204

[22] Filed: Oct. 31, 1994

[51] Int. Cl.[6] ..... B65H 39/10

[52] U.S. Cl. ..... 271/297; 271/298; 271/305

[58] Field of Search ..... 271/297, 305, 271/303, 298, 287, 274, 272

[56] References Cited

U.S. PATENT DOCUMENTS

| | | | |
|---|---|---|---|
| 3,622,059 | 12/1969 | Savela | 271/272 X |
| 3,937,459 | 2/1976 | Lawrence | 271/173 |
| 4,190,185 | 2/1980 | Thate | 271/274 X |
| 4,364,554 | 12/1982 | Akers | 271/272 |
| 4,502,804 | 3/1985 | Willcox | 271/272 X |
| 4,650,178 | 3/1987 | Steele et al. | 271/297 X |
| 4,691,914 | 9/1987 | Lawrence | 271/297 |
| 5,267,729 | 12/1993 | Hirota et al. | 271/297 |
| 5,346,205 | 9/1994 | Lawrence | 271/297 |

OTHER PUBLICATIONS

IBM Technical Disclosure Bulletin, vol. 23 No. 7A, Dec. 1980, pp. 2690–2691, "Traveling Roller Drive" by D. C. Estabrooks et al.

*Primary Examiner*—David H. Bollinger
*Attorney, Agent, or Firm*—Newton H. Lee, Jr.

[57] ABSTRACT

A sheet receiver has sheet feeding belts and coacting feed rollers for transporting sheets of paper to selected vertically spaced trays and a resilient pressure is applied between the feed rollers and the belts to drive the feed rollers due to the compressive force between them for transporting sheets to the respective trays.

7 Claims, 5 Drawing Sheets

RESILIENT SHEET TRANSPORT SYSTEM

BACKGROUND OF THE INVENTION

In the use of electronic printers in the office, particularly in the case of networked printers, the output from which may be designated for different recipients, it has become desirable that random access sorting devices be employed for segregating different jobs or different sets of sheets designated for different individuals.

Devices which are useful for these purposes are well known and have employed various means for transporting the sheets from the printers to selective receiver trays. Such devices are typically sorting machines useful also with office copiers to collate sets of copies produced by the copier.

THE PRIOR ART

Examples of the prior art are shown in Lawrence U.S. Pat. No. 3,937,459 granted Feb. 10, 1976 and Hirota et al U.S. Pat. No. 5,267,729 granted Dec. 7, 1993 wherein belts are employed in a sheet transport mechanism to carry the successive sheets along a sheet path in which are disposed normally closed gates which may be selectively opened to deflect a sheet into a receiver tray.

Other examples of sorters useful as mailboxes which employ a transport system involving feed rolls and nip rolls are shown in, for example, Lawrence U.S. Pat. No. 4,691,914, granted Sep. 8, 1987 and in Lawrence U.S. Pat. No. 5,346,205 granted Sep. 13, 1994. These latter types of sorting devices are relatively complicated and involve driven gear sets for driving the sheet feeding rolls and respective actuator mechanisms for momentarily moving the sheet deflector gates to the open position or moving a sheet deflecting roll to a position at which the sheets are deflected into the respective trays in a random manner.

SUMMARY OF THE INVENTION

The present invention contemplates a relatively simple and inexpensive, novel sheet transport system in which successive sheets are supplied to selected trays and deflected by gates into the trays by a gate opening system as for example, disclosed in the pending application of Peter Coombs and Klaus Thogersen, Ser. No. 325,159, filed Oct. 21, 1994, and co-owned herewith, and wherein the sheet transport system includes a pair of belts spaced at the side edges of the sheet feed path, the gates spanning the sheet feed path, and sheet feed rollers are in pressure contact with the belts to press the side edges of the sheets against the belts to carry sheets in combination with feed means cooperative with the feed rollers to carry a sheet to the respective trays upon movement of the gates to an open position.

In the specific embodiment of the present invention, the feed rollers and cooperative means which coact with the feed rollers are in resilient or compliant pressure contact with one another to carry a sheet into a tray. The feed rollers are in compliant or resilient contact with the belts, so that upon driving of the belts, the compliance provides a driving force which effects movement of the sheets through the feed path, and when a gate is in the open position, the gates are operative to deflect sheets into the selected trays, all due to the necessary drive force being imparted to the sheet by the resilience or compliance, without need for specific drive mechanism for the feed rollers to move sheets into the tray. In the form shown herein, the means cooperative with the feed rollers to carry the sheets into the trays comprises nip rollers in compliant frictional engagement with the feed rollers to maintain the drive force derived from the belts on the sheets to finally discharge the sheets into the trays.

In the illustrated specific form of the sheet receiver shown herein, as more specifically disclosed and claimed in the above mentioned pending application, the gates or deflectors are pivotally mounted in the usual manner so as to be actuated between the normally closed and open positions to selectively deflect a sheet from sheet transport belts into a selected tray, wherein at the appropriate location along the sheet feed path, all of the gates are simultaneously resiliently urged towards the open position, so that the gates downstream in the sheet feed path from the selected gate which is to deflect a sheet into a tray are all resiliently biased to the open position, but the gates upstream from the selected gate, while being biased towards the open position, are retained in the closed position by engagement with the sheet traveling through the sheet path, and, as the sheet is deflected by the selected open gate into the selected tray, that selected gate is held in the open position by the passage of the sheet into the tray, until the trailing edge of the sheet has passed the selected open gate.

During feeding of the sheets into selected trays, the feed rollers coact with the belts and means cooperative with the feed rollers, herein shown as nip rolls, at the respective gates to deflect and finally discharge the sheets into the trays.

With such a construction, special drive gears are not required to drive feed rollers to cause movement of the sheets, when deflected by the gates because sufficient paper sheet friction drive force is provided by the system.

Figure 2:
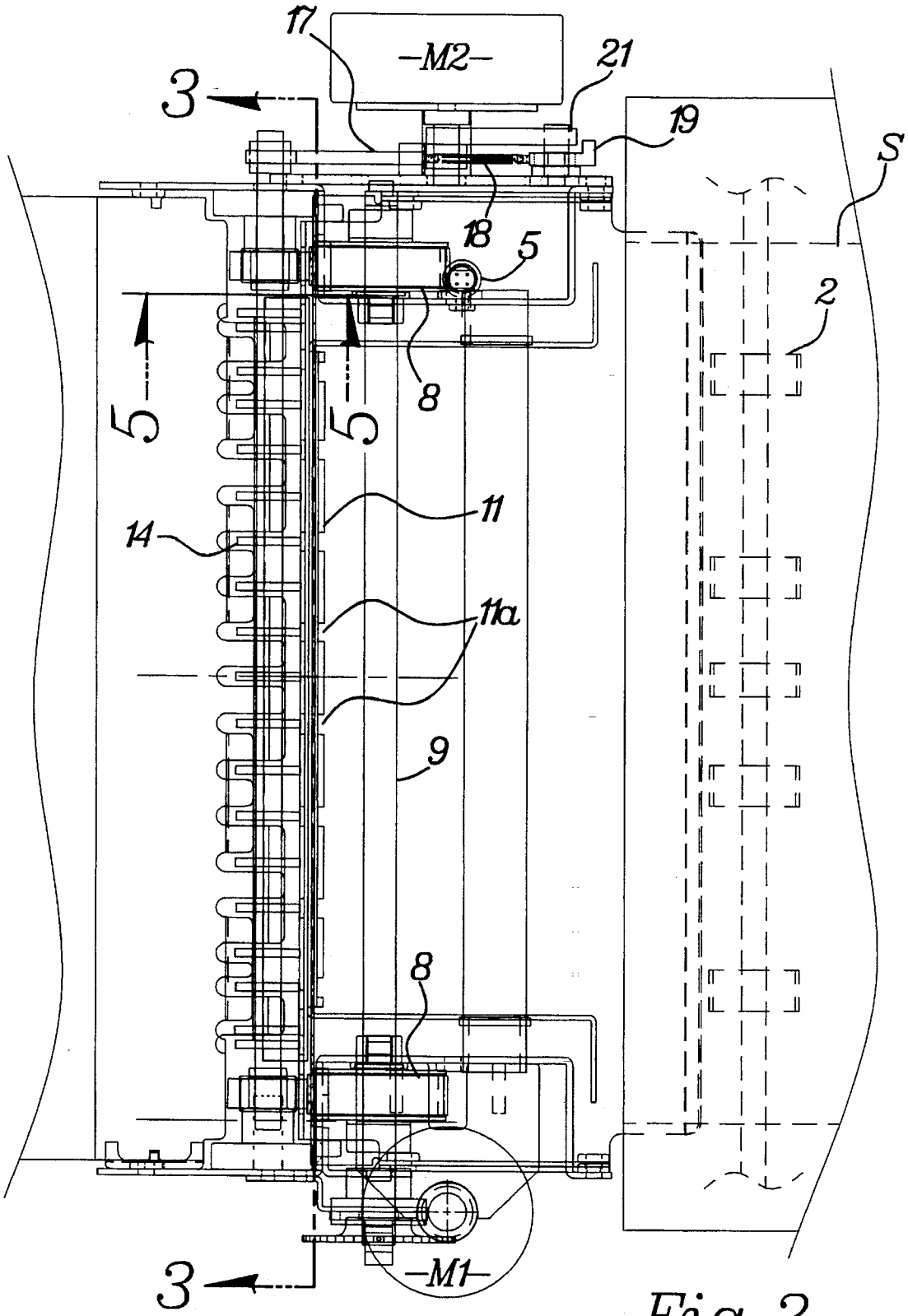
FIG. 2 is a top plan view thereof.
Figure 4:
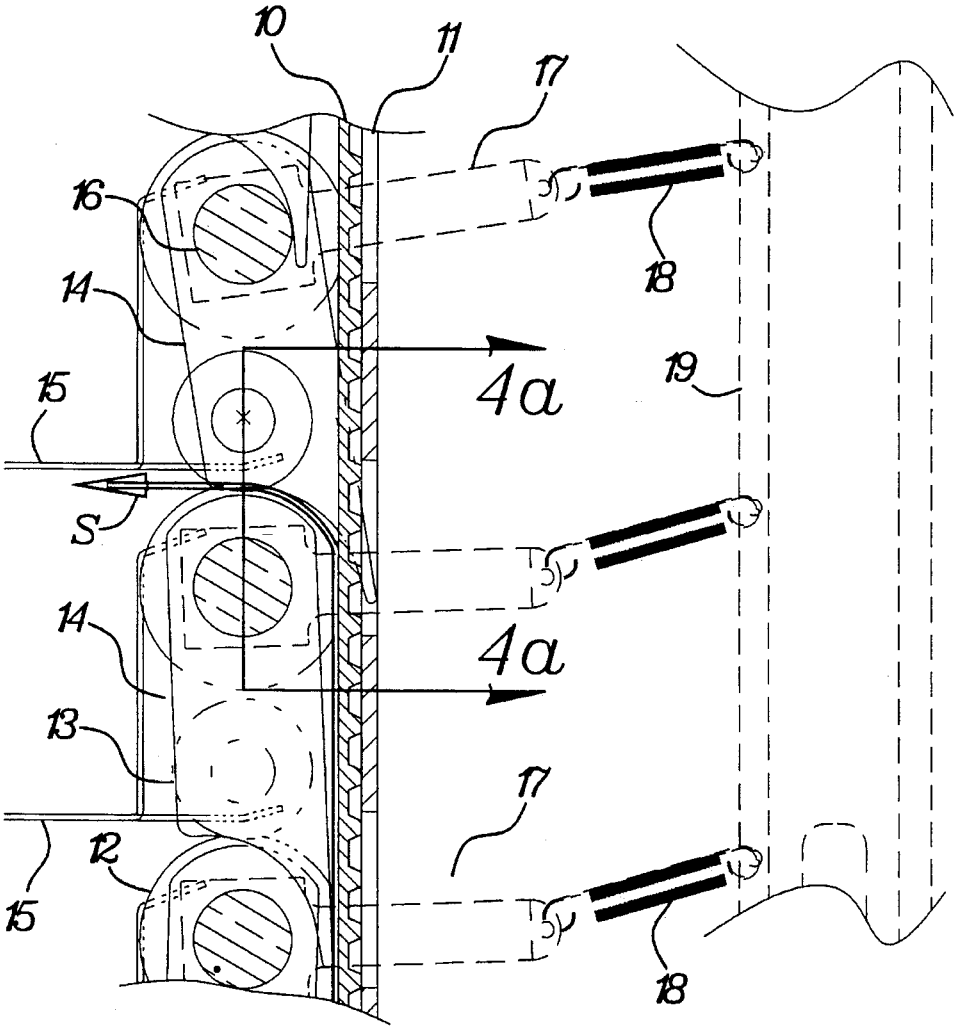
FIG. 4 is a fragmentary vertical section on the line 4—4 of FIG. 3, showing representative gates in an open and closed position.
Figure 5A:
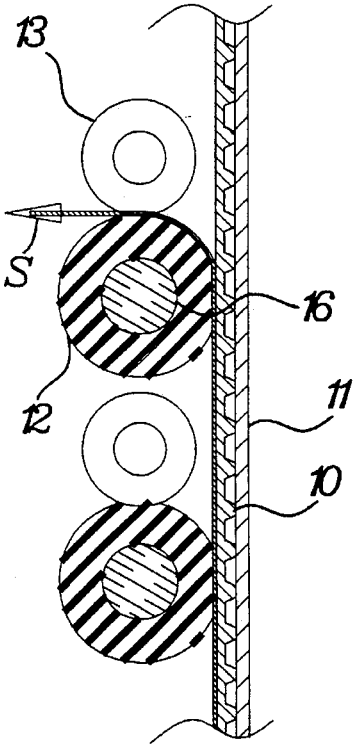

FIG. **4*a* is a fragmentary vertical section on the line 4*a* of FIG. 4**;

FIG. **5*a* is an enlarged fragmentary detail view as taken on the line 5—5 of FIG. 2** showing a preferred form of the belt driven, resilient sheet transport system of the invention;

FIG. **5*b* is a modified form of the system of FIG. 5*a*;**

FIG. **5*c* is another modification of the system of FIG. 5*a*; *and***

FIG. **5*d* is still another modification of the system of FIG. 5*a*.**

DESCRIPTION OF THE PREFERRED EMBODIMENT

As seen in the drawings, a sorter mailbox SM is illustrated in association with a printer P.

Printer P is adapted to produce printed sheets of paper S which are supplied by output rolls 2 to an infeed guide 3,4 for the sorter mailbox. Successive sheets are supplied to the guide and the leading edge of the sheet will be detected by a photosensor switch 5.

Figure 3:
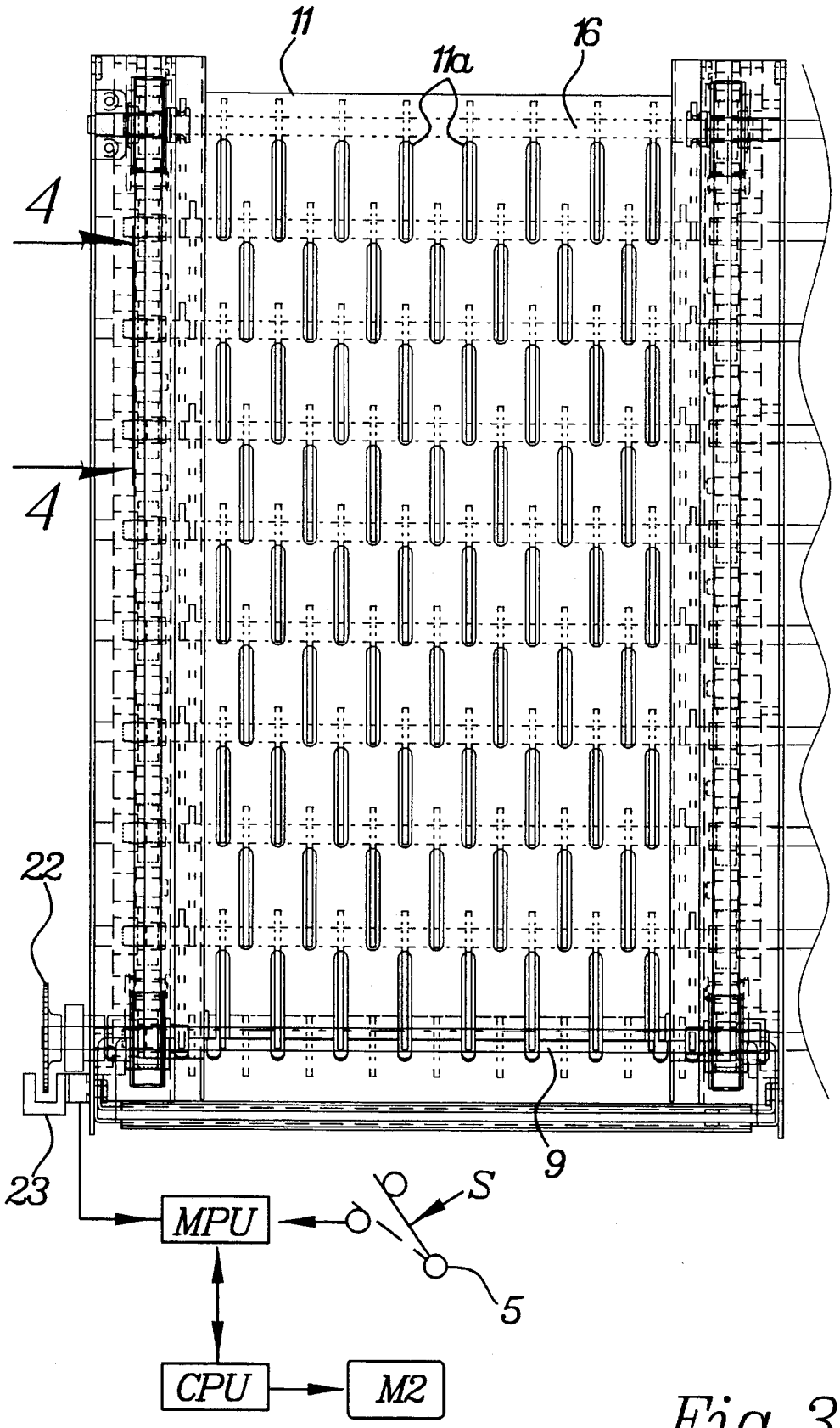
FIG. 3 is a vertical section on the plane of the line 3—3 of FIG. 2.

A drive motor M1 is adapted to drive through suitable gearing, such as a worm 6 and a worm gear 7, a pair of belt pulleys 8 at opposite ends of a cross shaft 9, and a transport belt 10, at each side of the assembly, is trained about the pulleys 8 with a sheet engaging run extending upwardly in sliding engagement with a vertical plate 11 which, as seen in FIG. 3, has rows of horizontally spaced vertical slots 11*a*. Drive or infeed rollers 12 and idler or nip rollers 13 are spaced vertically with the drive rollers 12 in frictional confronting engagement with the sheet engaging run of the belts to cause the sheets S to be transported along the feed path defined by the belts and drive rollers.

Associated with each set of rollers 12 and 13, is a pivoted gate or deflector 14 which is adapted when moved to the open position, as will be later described, to deflect a sheet into one of the vertically spaced sheet receiving trays 15. The gates 14 extend across the distance between the sheet transporting means at opposite sides of the apparatus. The nip rollers 13 coact with the feed rollers 12 and provide means to carry the sheet fully into the tray.

Figure 1:
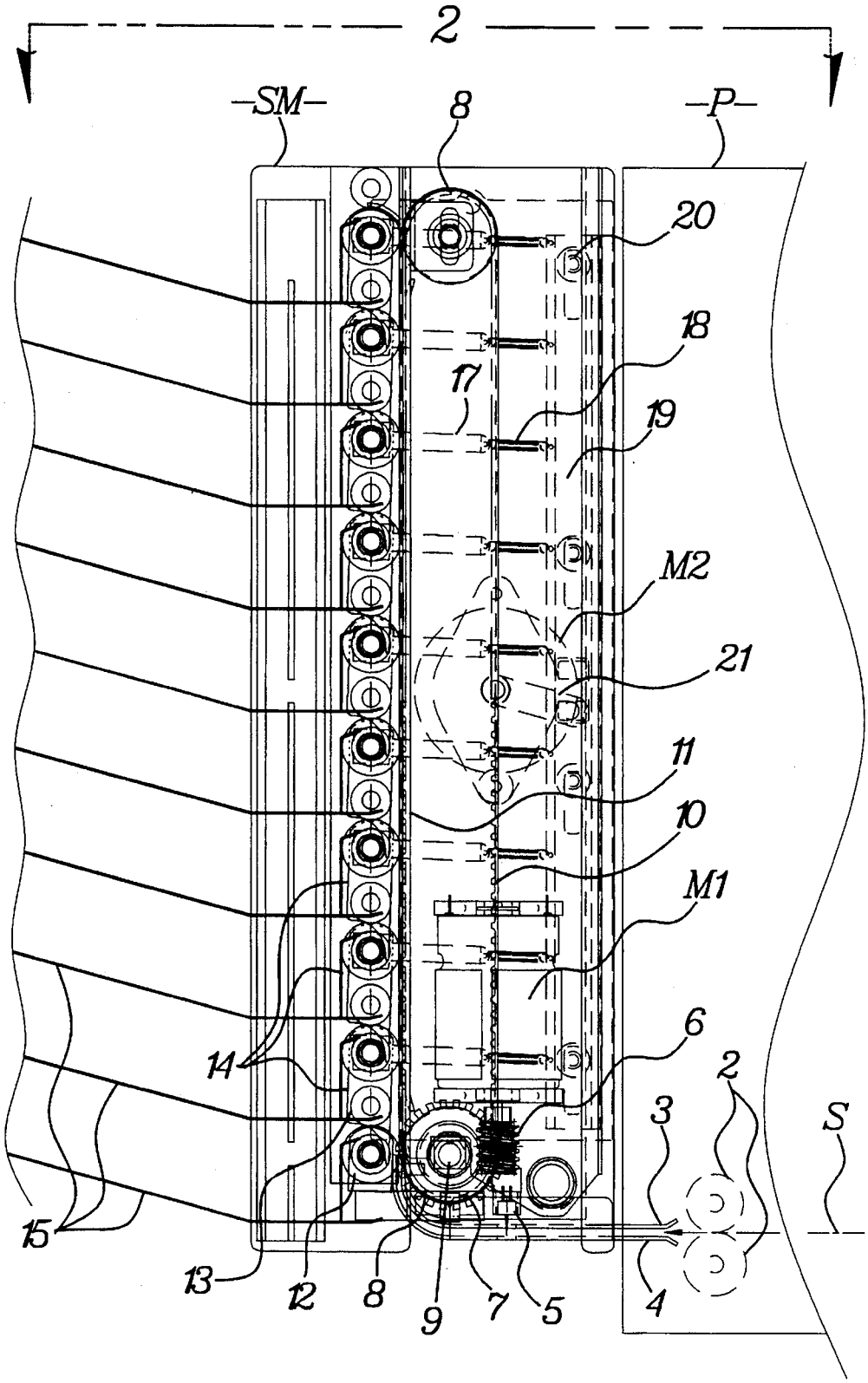
FIG. 1 is a side view, with the side cover removed, showing a sorter mailbox in accordance with the invention applied to a printer.

Referring to FIGS. 1 and 4, it will be seen that the gates 14 are each mounted on a rockable shaft 16 and each shaft 16 has an arm 17 connected by a tension spring 18 to a vertically shiftable slide 19 guided by shoulder pins 20 in the frame and vertically shiftable by a crank arm 21 of a motor M2 so as to be shifted between a lower position and an upper position shown in FIG. 4.

In the lower position each of the gates 14 is in a closed position so that a sheet moving vertically with respect to the trays will move from the guide 3,4 previously referred to, in an upward direction without interference from the gates, but when the arm 21 moves slide 19 upwardly, the gates are all moved toward the open position by the tension of the springs 18, so that sheets may be fed through the feed path to a selected tray, as will be later described.

As best seen in FIG. 3, at one end of the cross shaft 9, which drives the sheet feeding belts, is a code wheel 22 cooperative with an optical sensor 23 and the photosensor 5, through microprocessor unit MPU to detect the speed of paper movement and, therefore, the location of the lead edge of the paper along the feed path is detected.

A control processing unit CPU, in combination with the microprocessing unit MPU, provide means which enable the control of the mailbox in such a fashion that depending upon the position of the paper along the feed path, as detected by the MPU, the deflector actuator motor M2 will be energized so as to cause a sheet to be deflected into a selected tray.

Referring to FIG. 4, the mode of operation of the MPU and CPU and actuation of the gates by the motor M2 is more clearly illustrated and is more fully illustrated and described in the above mentioned pending application. A sheet of paper S is shown as being transported upwardly in the feed path between the belts 10 and the slotted back plate 11 past lower gates 14 associated with the tray 15 into which the sheet is to be selectively diverted. In this view, the paper is being moved upwardly by the belt as a result of the pressure applied between the belt 10 and the lowermost feed roller 12 so that the leading edge of the sheet has passed beyond the lowermost tray 15.

Under the condition that the intention is that the paper be deflected into the lowermost tray 15 in FIG. 4 by gate 14 associated therewith, the control signal from the MPU will cause the motor M2 to shift the slide 19 to the uppermost position at which the springs 18 pull the gate arms 17 and apply a light resilient load on the lower ends of the gates to move those lower ends toward an open position so as to lightly engage the paper sheet by the lower gate of FIG. 4. However, the upper gate 14 in FIG. 4 is allowed to open under the light spring force so that as the sheet S continues upwardly, the leading edge of the sheet will be deflected between the feed roll 12 and the companion idler or nip roll 13 into the lowermost tray 15, as indicated by the arrow, under the continuing friction drive imparted by belt 10, the feed roll 12 and associated nip roll 13.

It will be recognized that if a second sheet of paper S were to be destined for any tray either below or above the paper shown in FIG. 4, such second sheet of paper may be in the sheet path at any position of the second sheet behind the trailing edge of the sheet shown in FIG. 4.

The sheet of paper S in FIG. 4, upon movement of its trailing edge through the feed roll 12 and nip roll 13, allows automatic closure of the gate 14, and the motor M2 may again be actuated to re-open all of the gates above the point at which the leading edge of the paper is compressed between the belt and the lowermost feed roll associated with the next tray into which a sheet is to be fed.

As seen in FIG. 4, the feed rollers 12 are in frictional drive engagement with the belt 10 so as to cause movement of the sheet S due to the frictional drive induced between the feed rollers and the belt. The feed rollers 12, in this form, provide the means to cause frictional drive because they are resiliently or compliantly in pressure contact with the belt so as to require no separate driving force or motor for the feed rollers.

Figure 4A:
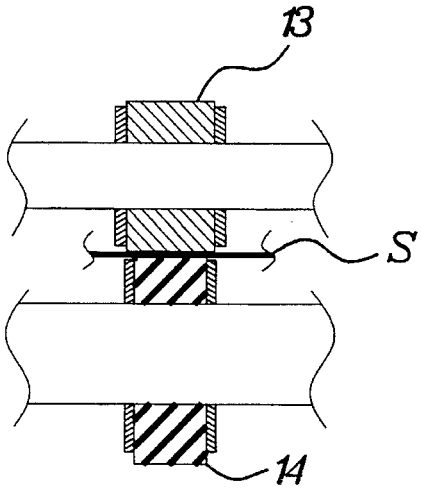

In addition, the nip rollers 13, as seen in FIG. 4*a*, are in resilient or compliant frictional engagement with the sheet and the drive rollers 12 so that the nip rollers 13 are also driven by the feed roller, and therefore, by the belt.

For these purposes the drive rollers 12, as shown in FIGS. 4*a* and 5*a*, are composed of a resilient plastic or elastomeric material. Since the slotted back plate 11, against which the feed belt 10 is supported, provides a rigid backup for the rollers 12, in the form of FIG. 5*a*, the extent of the resilient deformation of the feed roller 12 against the belt to cause the appropriate drive force will be determined by the shore of the resilient material of the feed roller and the relative positioning of the shaft 16 to the back up plate 11. The paper drive force between the feed roller and the nip roller 13 is also determined by the resilience of the feed roller.

Figure 5B:
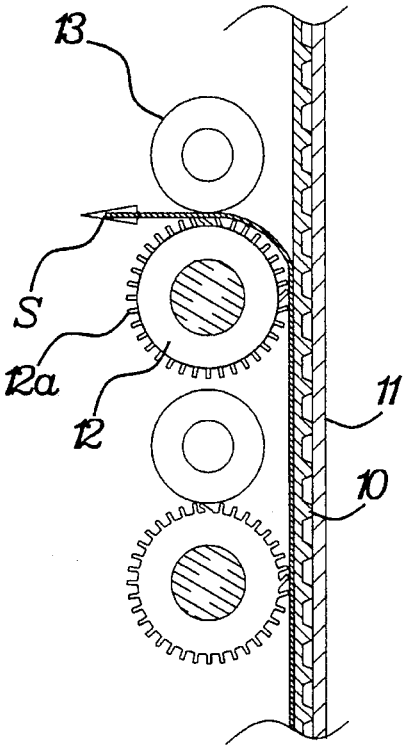

Referring to FIG. 5*b*, a variation or modification of the cooperative relationship between the feed roller 12 and the belt 10 is illustrated whereby the necessary drive force is transmitted to the drive roller 12 from the belt and the drive roller to the nip roller 13, just as in the case of the structure of 5*a*. Here, however, the feed roller 12 is or may be relatively hard but provided about the periphery with circumferentially spaced resilient ribs 12*a* capable of sufficient flexing as to induce the necessary frictional drive force.

Figure 5C:
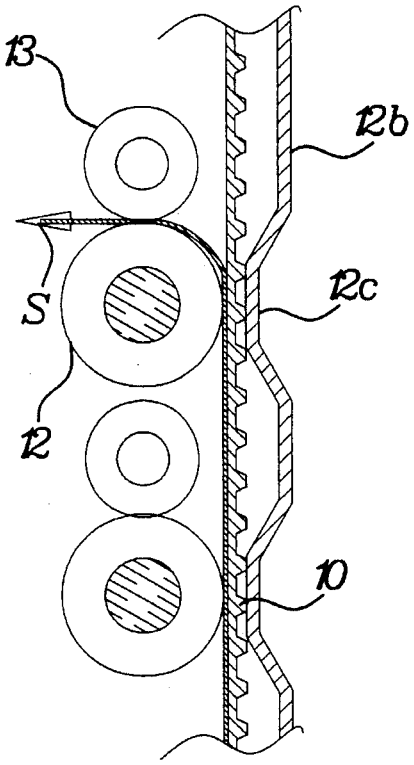

Referring to FIG. 5*c* another variation is illustrated wherein relatively non compliant feed rollers 12 are employed but the resilient drive force is provided from a spring member 12*b* having at least resilient portions 12*c* backing up the belt 10 in opposition to the respective feed rollers 12.

Figure 5D:
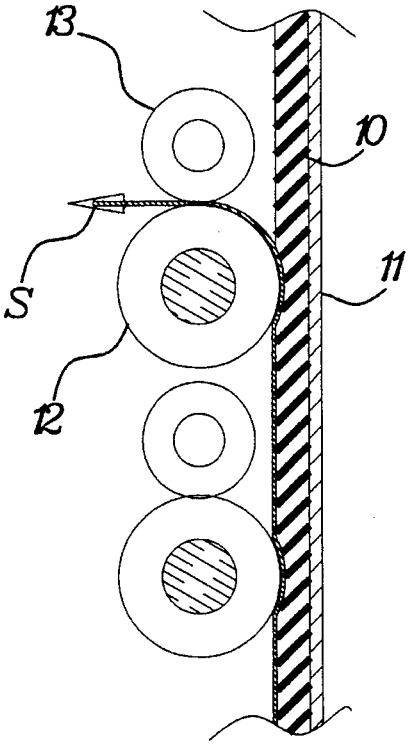

Still another variation is illustrated in FIG. 5*d* wherein the drive belt 10 is itself formed of a resilient or compliant material causing the necessary drive friction for the paper and the feed rollers 12 as the belt moves along the feed rollers.

From the foregoing, it will be seen that the sorter assembly as a whole, incorporating the means for simultaneously moving all of the gates towards an open position and the belt driven feed and nip roll system wherein the belts are located at the opposite sides of the gating system and the frictional drive between the belts and the feed rolls and nip rolls provide for a relatively simple and inexpensive mailbox or sorter construction with minimum application of motor forces typical of the usual fixed bin mailboxes and sorters.

We claim:

1. In a sheet receiver for use with a printer or copier comprising: an array of vertically spaced and horizontally extended trays for receiving sheets, sheet transport means for moving sheets vertically in a path along sheet inlet ends of said trays, gates at the respective sheet inlet ends of said trays and normally in a closed position allowing vertical transport of sheets past the sheet inlet ends of said trays and selectively swingable to positions to deflect a sheet into a selected tray, the improvement wherein said sheet transport means includes belts having runs movable vertically at said sheet inlet ends of said trays, a belt support backing up said runs of said belts, infeed rolls mounted opposite to said runs of said belts to drive a sheet therebetween, means coacting with said infeed rolls for carrying a sheet deflected by a selected gate to a selected tray, and including means for applying a resilient, compressive frictional drive force between said belts and said infeed rolls to frictionally drive said infeed rolls wherein said gate actuating means are operable to swing said gates simultaneously toward a sheet deflecting position into resilient pressure contact with a sheet moving between said belts and said feed rollers and in advance of the leading edge of said sheet moving in said path.

2. In a sheet receiver as defined in claim 1, wherein said sheet transport belts extend along the side edges of said feed path, said gates spanning said feed path between said sheet transport belts.

3. In a sheet receiver as defined in claim 1, wherein said means for applying a resilient, compressive force to the sheets between said belts and said infeed rolls comprises said infeed rolls formed of resilient material and deformable against said belts and said belt support.

4. In a sheet receiver as defined in claim 1, wherein said means for applying a resilient compressive force to the sheets between said belts and said infeed rolls comprises resilient ribs spaced circumferentially about said infeed rolls and resiliently deformable against said belts and said belt support.

5. In a sheet receiver as defined in claim 1, wherein said means for applying a resilient compressive force to the sheets between said belts and said infeed rolls comprises said belt support being formed of resilient material biasing said belts into frictional engagement with said feed rollers.

6. In a sheet receiver as defined in claim 1, wherein said means for applying a resilient compressive force to the sheets between said belts and said infeed rolls comprises said belts being composed of resilient material and deformable between said feed rollers and said belt support.

7. In a sheet receiver, as defined in claim 1, wherein said means coacting with said infeed rolls for carrying a sheet deflected by a selected gate to a selected tray comprises nip rolls associated with the respective infeed rolls and driven by rotation of said infeed rolls.

* * * * *